United States Patent [19]

Bleloch

[11] 4,303,230

[45] Dec. 1, 1981

[54] APPARATUS FOR THE PRODUCTION OF STEEL AND IRON ALLOYS

[76] Inventor: William Bleloch, 17 Rockridge Rd., Parktown, Johannesburg, Transvaal Province, South Africa

[21] Appl. No.: 98,251

[22] Filed: Nov. 28, 1979

[30] Foreign Application Priority Data

Nov. 28, 1978 [ZA] South Africa ..... 78/6675

[51] Int. Cl.[3] ..... C21B 7/16

[52] U.S. Cl. ..... 266/270; 75/60

[58] Field of Search ..... 266/270; 75/60

[56] References Cited

U.S. PATENT DOCUMENTS

| | | | |
|---|---|---|---|
| 3,241,825 | 3/1966 | Jilek | 75/60 |
| 3,558,119 | 1/1971 | Demalander | 266/270 |
| 3,746,534 | 7/1973 | Szekely | 75/60 |
| 3,793,002 | 1/1974 | Borgnat | 75/60 |
| 3,901,445 | 8/1975 | Chang | 75/60 |
| 3,917,243 | 11/1975 | Borgnat | 266/270 |

FOREIGN PATENT DOCUMENTS

| | | | |
|---|---|---|---|
| 220174 | 3/1962 | Austria | 75/60 |
| 1451383 | 9/1968 | Fed. Rep. of Germany | 75/60 |
| 2608924 | 8/1977 | Fed. Rep. of Germany | 75/60 |
| 1322636 | 2/1963 | France | 75/60 |
| 1429675 | 1/1966 | France | 75/60 |
| 1027552 | 4/1966 | United Kingdom | 75/60 |
| 1156740 | 7/1969 | United Kingdom | 75/60 |

*Primary Examiner*—P. D. Rosenberg

*Attorney, Agent, or Firm*—Cushman, Darby & Cushman

[57] ABSTRACT

This invention relates to a water-cooled lance suitable for top-blowing molten metal with oxygen entraining hydrogen extraneously to the lance characterized in that the oxygen nozzle (1) thereof includes an annular passage (8) which converges and then diverges inwardly towards the longitudinal axis of the lance and the hydrogen nozzle (9) is an inner nozzle which includes a right circular cylindrical axial passage through a member (7) centrally located in the oxygen nozzle.

3 Claims, 1 Drawing Figure

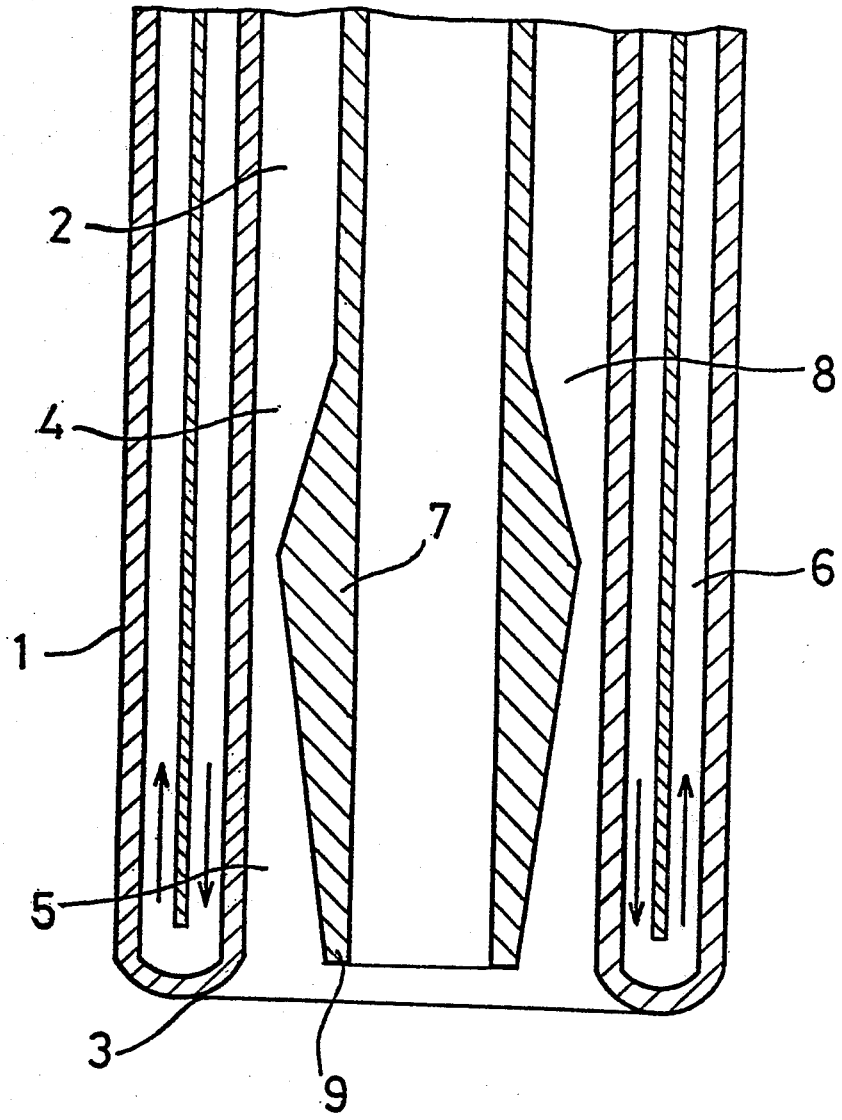
2
4
1
5
3
9
7
8
6

APPARATUS FOR THE PRODUCTION OF STEEL AND IRON ALLOYS

This invention relates to metallurgical apparatus and particularly to lances for top blowing metal melts.

In this specification the term "ferrous metals" is used generically to include iron, iron alloys, steel, steel alloys, and the like.

It is known to remove carbon from molten and superheated ferrous metals by treatment in a converter vessel with a supersonic jet of oxygen by the procedure well known in the steel industry as top blowing. The supersonic jet or jets of oxygen in top blowing are usually generated by means of a convergent-divergent nozzle or nozzles at the orifice end of the water-cooled vertically disposed converter lance used in the top blowing process. In this process the oxygen is passed into a central pipe in the lance at a pressure and rate of flow sufficient to generate the supersonic jet of oxygen on passing through the throat and divergence of the nozzle. The divergence of the nozzle or nozzles therefore of the jet generated by them is outward from the central length-wise axis of the lance.

It is an object of this invention to provide an improved annular-orifice oxygen lance with means for entrainment of hydrogen in any desired proportion with the oxygen stream externally to the lance for the decarburization of ferrous metals.

According to this invention there is provided a water-cooled lance suitable for top-blowing molten metal with oxygen entraining hydrogen extraneously to the lance which is characterised in that the oxygen nozzle thereof includes an annular passage which converges and then diverges inwardly towards the longitudinal axis of the lance and an inner nozzle which includes an axial passage through a member centrally located in the oxygen nozzle.

Further features of the invention provide for the axial passage of the inner nozzle to be right circular cylindrical; for the inner nozzle to be for hydrogen and for the convergence and divergence of the annular oxygen nozzle to be provided by the outer wall of the member positioned in the nozzle and comprising a pair of co-axial conical or frusto-conical surfaces with the outer wall of the passage being preferably right circular cylindrical. The conical surface providing the convergence preferably has a greater cone angle than the conical surface providing the divergence and these cone angles are less than 90° and preferably less than 60°.

The invention also provides a locating rod co-axially connected to the said member for locating the member within the nozzle, the position of the member with respect to the orifice of the nozzle being adjustable within limits by axial movement of the locating rod.

The locating rod is so constructed as to have a right-circular cylindrical axially-positioned channel along its whole length, the said channel extending to form the axial passage through the said frusto-conical member.

The outlet from the right circular cylindrical passage is a circular orifice located at the frusto-apex of the conical surface of the outer wall which provides the annular divergence for the oxygen nozzle.

A further feature of this invention provides for the said right-circular cylindrical passage to be preferably of larger diameter than that of its circular orifice.

A still further feature of this invention provides for the said circular orifice, if located at the end of a circular passage of larger diameter, to have a length equal to its diameter or to a small multiple of its diameter.

The annular passage for oxygen is further characterised such that its point of minimum cross-sectional area (or throat)($A_t$) and its exit orifice area $A_e$ are related approximately in the manner described by the formula:

$$\left(\frac{A_t}{A_e}\right)^2 = 15\,(\alpha^{1.4} - \alpha^{1.7})$$

where $\alpha = P_e/P_o$ where Po is the maximum absolute gas pressure in use at the inlet to the convergence of the annular passage and Pe is the absolute gas pressure in use at the exit orifice of the annular passage.

The circular passage is designed for use with hydrogen and would have a circular orifice diameter determined by the desired mass flow rate W and the required feed pressure into the lance $P_o$ in terms of the equation $$W = A_t\left\{O_o \cdot P_o \cdot \left(\frac{2}{\alpha+1}\right) \text{ to the power } \frac{(\alpha+1)}{(\alpha+1)} \cdot g\right\}^{\frac{1}{2}} \text{ at } 298^\circ \text{ K.}$$

where $\alpha$ = ratio of specific heats for hydrogen $P_o$ = density of hydrogen and $A_t$ = area of circular channel

BRIEF DESCRIPTION OF THE DRAWING

An example of the converter lance according to this invention is illustrated in the accompanying drawing which shows a diagrammatic cross-section through the outlet end of the lance according to this invention.

DETAILED DESCRIPTION OF THE DRAWING

As shown the converter lance comprises a straight elongated outer pipe 1 of circular bore 2. The outlet end 3 of this pipe is in the form of an annular convergent-divergent nozzle with the convergent portion 4 having a cone angle preferably less than 60° and the divergent portions 5 having a cone angle preferably also less than 60° but less than that on the convergent portion.

The wall of the outer pipe 1 includes a water cooling jacket 6.

Co-axially located within the outer pipe is an inner pipe 7 which is of considerably smaller diameter than the inside diameter of the outer pipe 1. Thus an annular passage 8 is formed between the inner and outer pipes.

The end portion 9 of the inner pipe 7 is located either at or within the outlet from the outer pipe 1. The outlet has a straight cylindrical nozzle and the location of the inner pipe 7 ensures that the nozzle of the outer pipe is annular.

The inner pipe 7 may be made movable axially but will always be located to ensure a proper convergent-divergent annular oxygen nozzle which will enable a supersonic jet of oxygen to be produced from the outer pipe 1.

This can be most easily effected by having formations on the outer wall of the inner pipe to provide the annular convergent-divergent jet.

The lance may be made from conventional materials used for oxygen blowing art and standard or readily modified equipment can be used to supply and regulate gas flow to the upper end of the lance. Conventional lance handling equipment can also be used when the lance is fitted in a converter installation.

The lance may be used to decarbonise a bath of superheated ferrous metal by initially passing oxygen alone down the outer pipe 1.

At any stage thereafter hydrogen is passed down the inner pipe 7 simultaneously with oxygen down the annular passage of the outer pipe.

Under these circumstances the oxygen from the annular orifice of the lance entrains hydrogen from the inner pipe 7 so that an oxygen-hydrogen mixture emerges at supersonic velocity from the lance orifice 3. Here the components of the mixture react to give a high velocity, high temperature, water vapour jet which is used in the decarburization of the super heated molten ferrous alloy in a suitable receptacle.

EXAMPLES OF THE INVENTION

An example of the decarburization of a charge of pig iron and scrap steel using the lance above described is set out below.

The invention is applied to the decarburization of a converter charge of 100 tons of scrap carbon steel and low phosphorous pig iron. The metal would be charged into a previously heated basic lined top-blown converter vessel:

70 tons of iron from a metal mixer at 1490° C.

10 tons molten and superheated scrap steel from a basic lined arc furnace by ladle at 1580° C.

20 tons scrap steel charged to the converter cold during operation.

The scrap steel has 0.32% carbon, 0.3% silicon and the iron 3.8% carbon and 1.2% silicon, the carbon equivalent of the charge being approximately 3.5% and the temperature of the initial 80 tons on emplacement in the converter being approximately 1500° C. The converter in this example is provided with an inverted truncated conical bottom to give a central metal depth of 1.6 meters and a bath diameter of 3.7 meters for the 100 ton charge.

The lance and gas characteristic for the decarburization of this 100 ton charge are as follows:

i. cooling water rate 2 $m^3$/minute at 25° C. inlet temperature.

ii. annular convergent-divergent channel with inverted divergence:
throat area: 15.2 $cm^2$
throat width: 0.69 cm
exit area: 36 $cm^2$
exit width: 2.0 cm
cone angle: 13°
throat length: 0.4 cm
divergence length: 10 cm
annulus outer diameter: 7.7 cm
annulus inner diameter at exit: 3.7 cm
max. oxygen flow rate: 320 $m^3$/min.
max. oxygen throat pressure: 275 psig iii. The area of the inner circular pipe orifice 9 is 5.7 $cm^2$ and the maximum hydrogen flow is 740 $m^3$/minute at orifice inlet pressure of 400 psig.

Immediately after emplacement in the converter vessel and charging the slag-forming materials in this case 3.4 tons of burned lime of 9.16% calcium oxide content and 100 kilograms of fluorspar of 82% $CaF_2$ content the charge would be blown with oxygen up to the maximum flow rate specified above.

During the course of the blowing operation, which would follow the normal top-blown converter practice in slagging off when required and sampling to monitor carbon, silicon, sulphur, and phosphorus removal, the remaining charge of cold steel scrap would be added as usual in the oxygen process to control the temperature of the metal bath. Blowing under these conditions would continue until the carbon has decreased to about 0.4% the time of blowing to this stage over and above time spent on slagging off, sampling, analysis, and cold scrap additions would be approximately 12.5 minutes.

At this stage or at any desired prior stage hydrogen may be passed into the central pipe of the lance to pass through its circular orifice at any desired flow rate up to 740 $m^3$ NTP/minute. The hydrogen ignites in the oxygen stream and the resulting high temperature water vapour jet continues to remove carbon to low levels from the metal being treated. The initial hydrogen flow rate may be for example 100 $m^3$ NTP/minute and may be gradually increased at the discretion of the operator in accordance with the desired final carbon content, which at the full hydrogen flow rate is expected to be 0.005% or less. Blowing under these conditions would continue for approximately 1.6 minutes. Thereafter, if required, hydrogen purging would be carried out by passing argon and/or nitrogen through the annular channel of the lance at the same flow rate and pressure as those used for oxygen, or at lower rates at the discretion of the operator. Argon or argon/nitrogen consumption would be approximately 1 to 2 $m^3$ NTP per ton of converter metal charge at a flow rate for example of approximately 200 $m^3$ NTP/minute at a lance orifice height of 0.7 m.

On completion of the hydrogen purging (which is unnecessary in the production of many alloyed and unalloyed steels) the metal is slagged-off if necessary, and cast after the required alloy additions.

An example of the decarburizing of ferrous metal for production of chromium-vanadium steel is set out below.

The invention is applied to the decarburizing of 50 tons of an alloy of iron containing 20% chromium 0.7% vanadium 5.2% carbon and 0.8% silicon made by submerged arc furnace reduction of sintered chromite fines and titaniferous iron ore. The charge of fifty tons of this alloy would be melted in a basic lined open-arc steel melting furnace and transferred to a previously heated basic lined top-blown converter vessel so that its temperature in the converter is at least 1580° C. The converter has a central metal depth of 0.8 m and a bath surface diameter of 3.6 meters from the 50 ton charge.

The required slag forming materials to be added to the charge are in this case 3.1 tons of burned lime of 91% calcium oxide content and 300 kg of flurospar.

The lance and gas characteristics for decarburizing this 50 ton charge of chromium-vanadium alloy, allowing for the oxidation of approximately 1 ton of its chromium content are as follows:

1. Cooling water flow rate 1.2 $m^3$/minute at 25° C. inlet temperature.

2. Annular convergent-divergent channel with inverted divergence.
throat area: 10.8 $cm^2$
throat width: 0.58 cm
exit area: 25.5. $cm^2$
exit width: 1.25 cm
cone angle: 14°
throat length: 0.4 cm divergence length: 10 cm
annulus outer diameter: 6.5 cm
annulus inner diameter at exit: 4.0 cm
max. oxygen flow rate: 180 $m^3$/min.
max. oxygen throat pressure: 218 psig 3. area of inner circular pipe orifice 9 is 7.1 $cm^2$ and the maximum hydrogen flow is 420 $m^3$/min at orifice inlet pressure 200 psi.

Immediately after emplacement of the charge in the converter and the charging of the slag-forming materials the charge is blown with oxygen at the specified maximum rate and the hydrogen in the ratio of 0.5/1 by volume, the hydrogen passing through the inner circular pipe and orifice and the oxygen through the annular lance channel and annular orifice. The hydrogen and oxygen pass through the circular and annular orifices at a lance orifice height above the metal surface of approximately 1 m and at an oxygen exit velocity of Mach 2.4.

Blowing would continue under these specified conditions for approximately 21 minutes to lower the carbon equivalent of the metal to approximately 0.8%. Thereafter the hydrogen flow rate would be increased to 2.3 times the oxygen flow rate which may be rated at the discretion of the operator up to the maximum flow rate specified. At the maximum flow rates blowing with oxygen and hydrogen would continue for approximately 3–4 minutes; whereafter the metal would be analysed.

The expected carbon content would be less than 0.01% and vanadium and chromium contents 0.6% and 17–18%. After analysis, and de-slagging if necessary, the metal would be purged with argon using for that purpose a low grade argon of, for example, 9% oxygen content up to an input of 1–2 $m^3$/ton of metal, by passing the argon down the oxygen annulus and orifice at 100 $m^3$/minute and hydrogen at 21 $m^3$/minute down the central pipe and orifice, for approximately 1 minute. The argon pressure for this purpose would be 120 psi and the lance orifice height above the metal 0.5 m at the discretion of the operator.

It will be clear to those versed in the art that the use of inert gases e.g. argon and nitrogen in this invention is not limited to the purging operation, but that any suitable inert gases such as argon and/or nitrogen may be used in admisture with Oxygen at any desired stages in the operation under the conditions specified.

It will further be apparent to those versed in the art that the central pipe 7 for conveying hydrogen to the orifice 9 may be water-jacketed for cooling if desired, as for pipe 1. Such an inner water jacket would normally be unnecessary but may be incorporated in the lance if, for example, it is desired to operate at low gas flow rates and low lance heights.

Variation of gas flow rates within the limits hereinbefore specified are attained by changing, at the discretion of the operator, the nozzle feed pressures and the lance operating heights above the metal bath to meet conditions arising during operation.

The lance may be constructed with two or more of the nozzles hereinbefore specified with their longitudinal axes divergent from the longitudinal axis of the lance downstream of the gas flow direction at low angles, preferably of the order of 8° to 10°, but the preferred construction is that of a single nozzle.

In the treatment of ferrous metals it may often be desirable to do this in a two stage process. In such cases the initial treatment of the ferrous metal with oxygen when required for partial removal of carbon down to a content of about 0.5% may be carried out in a converter vessel which may be top, bottom or side blown in accordance with known practice of oxygen blowing. After such initial treatment with oxygen the metal would be transferred by ladle or by direct pouring into a second acid or basic lined vessel, which may if required by inductively stirred and/or heated, for top-blowing treatment with the high-temperature high-velocity water vapour jet as described in the foregoing example of the practical application of this invention for the final removal of carbon to low levels of the order of 0.01% or less.

What I claim as new and desire to secure by Letters Patent is:

1. A water-cooled lance suitable for top-blowing molten metal with oxygen entraining hydrogen extraneously to the lance characterised in that the oxygen nozzle thereof includes an annular passage which converges and then diverges inwardly towards the longitudinal axis of the lance and the hydrogen nozzle is an inner nozzle which includes a right circular cylindrical axial passage through a member centrally located in the oxygen nozzle.

2. A water-cooled lance as claimed in claim 1, wherein the convergence and divergence of the annular oxygen nozzle is provided by the outer wall of said inner hydrogen nozzle and includes a pair of opposed co-axial frusto-conical surfaces which in cooperation with the oxygen nozzle outer passage form a narrowed passage for issuing a supersonic jet of oxygen from the lance and for entraining hydrogen extraneous of said lance.

3. A water-cooled lance for top-blowing molten metal with a supersonic stream of hydrogen entrained in oxygen, said lance having an oxygen nozzle including an annular passage which converges outwardly from and then diverges inwardly towards the longitudinal axis if said lance, a hydrogen nozzle positioned within the concentric of said oxygen nozzle to define a right circular cylindrical axial passage through a hydrogen delivery member positioned centrally within said oxygen nozzle, said hydrogen nozzle supported on a cylindrical rod axially adjustable with respect to said oxygen nozzle, said annular passage defined by a pair of co-axial conical or frusto-conical surfaces carried on the outer wall of said hydrogen nozzle to cooperate with the adjacent inner wall of said oxygen annular passage for oxygen, and cooling means for cooling said oxygen nozzle.

* * * * *